US012523123B2

(12) United States Patent
Shakeel et al.

(10) Patent No.: US 12,523,123 B2
(45) Date of Patent: Jan. 13, 2026

(54) DOWNHOLE FLUID SEPARATOR DESIGN IN MULTILATERAL WELL

(71) Applicant: Halliburton Energy Services, Inc., Houston, TX (US)

(72) Inventors: Muzzammil Shakeel, Dhahran (SA); Zac Arackakudiyil Suresh, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/812,667

(22) Filed: Aug. 22, 2024

(65) Prior Publication Data

US 2025/0067150 A1 Feb. 27, 2025

Related U.S. Application Data

(60) Provisional application No. 63/534,792, filed on Aug. 25, 2023.

(51) Int. Cl.
*E21B 43/38* (2006.01)
*E21B 33/122* (2006.01)
(Continued)

(52) U.S. Cl.
CPC ..... *E21B 41/0035* (2013.01); *E21B 33/122* (2013.01); *E21B 43/12* (2013.01);
(Continued)

(58) Field of Classification Search
CPC .. E21B 41/0035; E21B 41/0042; E21B 43/35; E21B 43/385; E21B 2200/20; E21B 2200/22
See application file for complete search history.

(56) References Cited

U.S. PATENT DOCUMENTS 5,711,374 A 1/1998 Kjos
5,762,149 A * 6/1998 Donovan ..... E21B 43/305 166/313
(Continued)

FOREIGN PATENT DOCUMENTS

CN 206522127 U 9/2017
CN 110331973 A 10/2019
(Continued)

OTHER PUBLICATIONS

International Search Report and Written Opinion for International Patent Application No. PCT/US2024/043576 dated Dec. 12, 2024. PDF file. 11 pages.
(Continued)

*Primary Examiner* — Blake Michener
(74) *Attorney, Agent, or Firm* — Scott Richardson; C. Tumey Law Group, PLLC

(57) ABSTRACT

A system may include a lower completion disposed in a main bore of a multilateral well in a position downhole from a junction of the multilateral well. The system may also include a fluid separator configured to receive formation fluid, which includes oil and water, flowing from the lower completion. The fluid separator may be configured to at least partially separate the formation fluid into formation oil and formation water. The fluid separator may also be configured to output the formation oil, via a separator oil outlet, to flow uphole, and output the formation water, via a separator water outlet, to flow toward a lateral bore of the multilateral well. Further, the system may include a water cut sensor disposed uphole from the fluid separator. The water cut sensor may be configured to measure the percentage of water in the formation oil.

20 Claims, 5 Drawing Sheets

(51) Int. Cl.
*E21B 41/00* (2006.01)
*E21B 43/12* (2006.01)
*E21B 47/06* (2012.01)

(52) U.S. Cl.
CPC ..... *E21B 43/385* (2013.01); *E21B 47/06* (2013.01); *E21B 2200/20* (2020.05); *E21B 2200/22* (2020.05)

(56) References Cited

U.S. PATENT DOCUMENTS

| | | | | |
|---|---|---|---|---|
| 6,012,015 | A * | 1/2000 | Tubel | E21B 43/14 702/6 |
| 6,311,776 | B1 * | 11/2001 | Pringle | E21B 41/0035 166/117.6 |
| 6,336,503 | B1 | 1/2002 | Alhanati et al. | |
| 6,547,003 | B1 | 4/2003 | Bangash et al. | |
| 6,923,259 | B2 | 8/2005 | Snow | |
| 10,583,373 | B2 | 3/2020 | Braaten et al. | |
| 11,913,322 | B1 | 2/2024 | Aleid et al. | |
| 2001/0017207 | A1 | 8/2001 | Haheim | |
| 2001/0020675 | A1 * | 9/2001 | Tubel | E21B 37/06 385/12 |
| 2001/0023614 | A1 * | 9/2001 | Tubel | G01V 1/40 73/152.39 |
| 2002/0185275 | A1 | 12/2002 | Yang et al. | |
| 2005/0121190 | A1 * | 6/2005 | Oberkircher | E21B 41/0035 166/250.1 |
| 2010/0089569 | A1 | 4/2010 | Van Zuilekom et al. | |
| 2011/0079388 | A1 * | 4/2011 | Cox | E21B 43/38 166/266 |
| 2017/0022761 | A1 | 1/2017 | Joshi et al. | |
| 2017/0022797 | A1 | 1/2017 | Joshi et al. | |
| 2017/0268322 | A1 | 9/2017 | Culbertson et al. | |
| 2018/0154282 | A1 | 6/2018 | Braaten et al. | |
| 2021/0230980 | A1 | 7/2021 | Steele et al. | |
| 2022/0035971 | A1 * | 2/2022 | Mahavadi | G01N 33/2823 |
| 2022/0162927 | A1 * | 5/2022 | Rowaihy | E21B 49/0875 |
| 2022/0403726 | A1 | 12/2022 | Al-Qasim et al. | |
| 2023/0066633 | A1 * | 3/2023 | Trisal | E21B 43/08 |
| 2023/0220759 | A1 | 7/2023 | Alrabaei et al. | |
| 2025/0067158 | A1 * | 2/2025 | Suresh | E21B 41/0035 |

FOREIGN PATENT DOCUMENTS

| | | | |
|---|---|---|---|
| CN | 113338875 | A | 9/2021 |
| WO | 9630625 | | 10/1996 |
| WO | 9837307 | A1 | 8/1998 |

OTHER PUBLICATIONS

Non-Final Office Action for U.S. Appl. No. 18/812,640 dated Jul. 21, 2025. PDF file. 28 pages.

* cited by examiner

DOWNHOLE FLUID SEPARATOR DESIGN IN MULTILATERAL WELL

CROSS-REFERENCE TO RELATED APPLICATIONS

The present application is a non-provisional conversion of U.S. Provisional Application Ser. No. 63/534,792, filed Aug. 25, 2023, the entire disclosure of which is incorporated herein by reference.

BACKGROUND

Oil and gas wells produce significant amounts of water in their lifetime. The percentage of water produced from these wells is called the water cut, the ratio of the water produced from the well compared to the volume of the total liquids produced. Most wells produce an ever-increasing water cut throughout their productive life. In many oil fields around the world the percentage of water recovered with oil has risen to be greater than the percentage of the oil. In fact, in many fields, the percentage of oil has decreased to be from about 20% in an excellent field to about 2% in a relatively poor field.

The end of a well's productive life is often determined by the water cut. A well is typically shut in when the value of the hydrocarbons produced is no longer sufficient to economically cover the operating costs of the well and the cost of disposing of the produced water. Indeed, disposing of the produced water is not environmentally and economically friendly as energy is used to power the pump to lift the produced water to the surface, to separate the produced water from the oil, to transport the separated water as it cannot be disposed on the surface in most cases. Thus, the separated water must be transported to a remote well site to be reinjected into a subterranean formation. Therefore, decreasing the water cut of a well increases the value of the produced fluids and directly decreases the disposal costs of the produced water.

One method of reducing the water cut of a well is to separate produced water from the hydrocarbons downhole, rather than at surface. Downhole separation increases the value of the fluids produced to the surface. Downhole separation also facilitates disposal of the separated water. The separated water can be reinjected into the same production zone or into a different production zone. Another way to improve the productivity of a well is to increase the length of the intersection of the productive zone by the well completion. One way of increasing this intersection length is by using multilateral wells. A multilateral well is a conventional well that has a lateral well that is drilled from a point in the original well. The lateral well increases productivity by allowing additional intersection length along the productive zone without the cost and delay involved in re-drilling the upper part of the well. While multilaterals enable multiple intersections within the same productive zone, multilaterals also enable fluid communication with different productive zones within a reservoir. In certain reservoirs, operators can leverage this approach to improve reservoir production by accessing numerous production zones or by increasing the contact area between a wellbore and a formation with minimal increase in drilling and completion costs. These techniques also reduce the environmental footprint of drilling rigs and subsequent production trees, particularly for land operations. Therefore, the use of multilateral well increases the potential production of a well and can also enable disposal of the produced water in a different zone.

BRIEF DESCRIPTION OF THE DRAWINGS

These drawings illustrate certain aspects of some examples of the present disclosure and should not be used to limit or define the disclosure.

DETAILED DESCRIPTION

Figure 1:
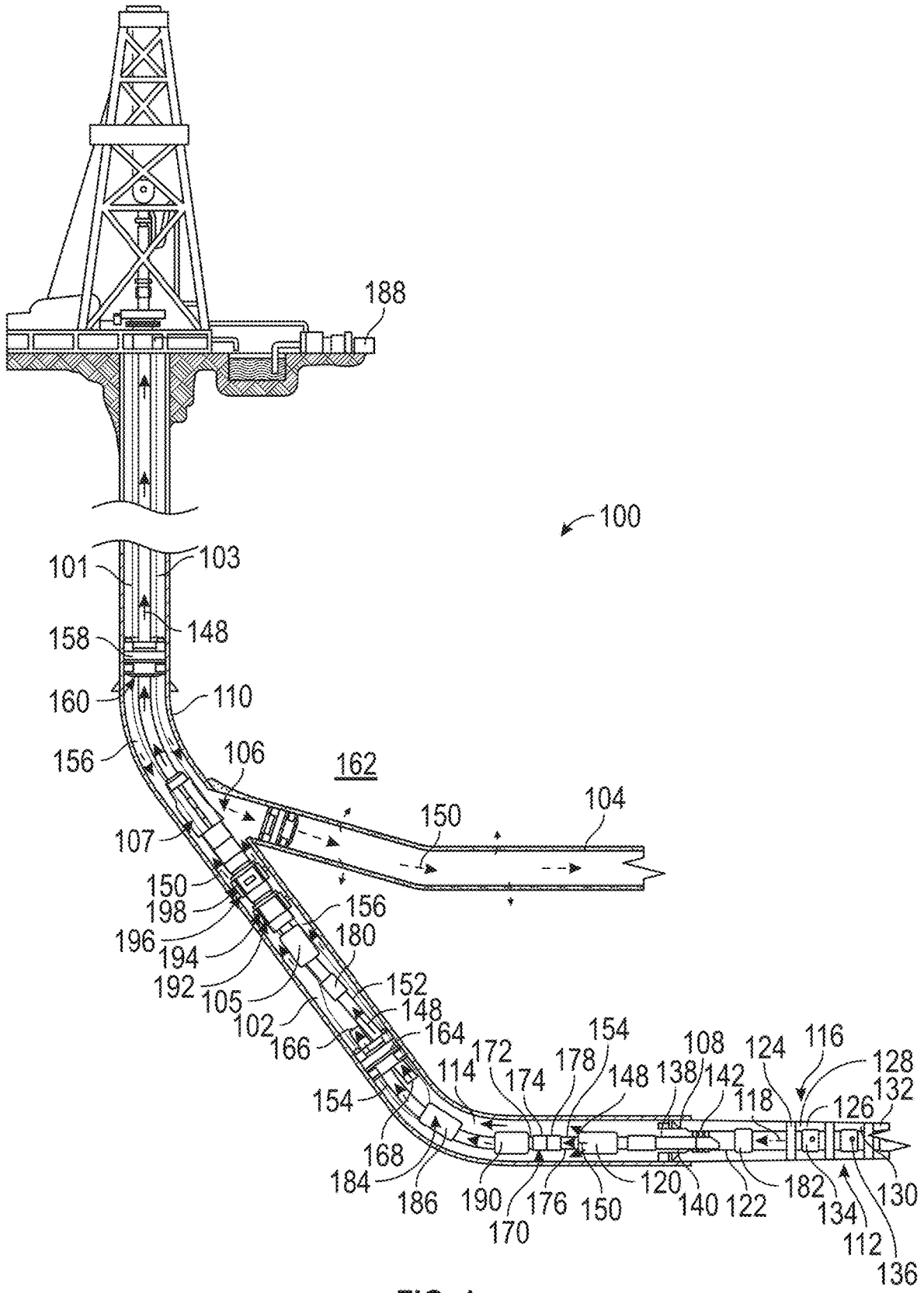
FIG. 1 illustrates a fluid separator assembly disposed within a multilateral well, in accordance with some embodiments of the present disclosure.

The present disclosure relates to the field of downhole fluid separator. More specifically, systems are described of multilateral well completion design to install fluid separator on the upper completion and inside a lateral well and methods of use thereof. A fluid separator includes an oil/water separator and a gas/oil/water separator, for example. Fluid separators that are installed downhole in multilateral oil wells can require that they are placed in long tangent sections within a wellbore, above the multilateral junction. However, the cost associated with the planification and implementation of a novel multilateral well is significant. In fact, the cost to design and install a downhole fluid separator with a tangent section may be as high as the cost of the entire multilateral well without the separator. In addition, the placement of the fluid separator above the multilateral junction requires installing it right from the onset when completing the well to minimize the risk of losing the well. In embodiments, the fluid separator can be placed in a lateral well instead of above the multilateral oil wells. This simplifies the installation. This reduced complexity allows the fluid separator according to embodiments of the present disclosure to be installed into existing wells, i.e., retrofitting existing wells. Further, the lateral well can be a target formation. The existing wells do not require a tangent section at the junction for the placement of the fluid separator, increasing significantly the number of oil well candidates for installation of the fluid separator according to embodiments of the present disclosure.

The design of the installed completion equipment is critical for the downhole fluid separator to function as intended. Current well designs place the downhole fluid separator above the multilateral junction. By installing the fluid separator according to embodiments of the present disclosure in one of the lateral wells, an existing watered out well can be re-entered, a new lateral added to it, and the separator installed within. This decreases the overall cost involved in installing the fluid separator according to embodiments of the present disclosure as compared with installing it at the completion of the well at the beginning of the life of the well. It also decreases the risks associated with installing downhole fluid separator according to embodiments of the present disclosure as existing wells that are already poor producers can be selected as candidates and represent a smaller cost if the well is lost during the trial as compared with selecting a potential well before well completion is finished. Using a fluid separator in a downhole setting combined with a multilateral junction provides efficiency gains. This includes converting poor performing wells, wherein the percentage of oil has decreased to about 2% for example, into a downhole water injector combined with a better producing well. Additional benefits include lower flow rate and pressure rating requirements, a lighter fluid column, and increased recovery. The fluid separator according to embodiments of the present disclosure may be particularly useful in low flow rate wells (in the 200 barrel per day range or less), which tend to be shallow, and relatively inexpensive to drill. Moderate flow rate wells, for example 500-5000 barrels of fluid per day, can also be potential candidates for the downhole fluid separator according to embodiments of the present disclosure. Finally, it will also be useful for most multilaterals with very high flow rate wells, up to 50,000 barrels of fluid per day, for example.

Multilateral wells are characterized according to definitions established in 1997 during a Technology Advancement of Multilaterals (TAML) Forum held in Aberdeen. These standards classify junctions as TAML Level 1, 2, 3, 4, 5, or 6 based on mechanical complexity, connectivity, and hydraulic isolation. The ascending order of these levels reflects increasing mechanical and pressure capability of the junction. Consequently, cost, complexity, and risk also generally increase at the higher TAML levels. However, other considerations of the well design also influence the overall complexity of the well—for example, a TAML Level 2 well with an advanced intelligent completion can be more complex and costly than a TAML Level 5 well with a simpler completion system.

In a TAML 1 well, the main bore, lateral, and junction are uncased. This basic lateral is designed to enhance reservoir drainage from consolidated formations. It has the advantage of low drilling and completion costs, but the open hole junction makes reentry into the lateral wellbore and control of flow from the lateral impossible.

Wells that have cased and cemented main bores and open hole laterals are designated TAML Level 2. A cemented main bore significantly reduces the risk of wellbore collapse and provides isolation between laterals. By placing sliding sleeves and packers in the main bore, operators can produce the bores singly or in commingle production.

Placing a liner in the lateral and mechanically connecting it to the cased and cemented main bore results in a TAML Level 3 well. A liner is a string of casing that does not extend to the surface but is anchored or suspended inside a previously run casing string. This TAML Level 3 well includes a lateral that is cased but not cemented at the junction. It is a relatively low-cost option that includes reentry capabilities and a lateral that is better supported than that of Levels 1 and 2. Using sliding sleeves and packer plugs, operators can produce the bores singly or in commingle production. A TAML Level 3 junction does not provide hydraulic isolation, and its use is restricted to consolidated formations.

TAML Level 4 junctions are applicable in both consolidated and unconsolidated formations because both the lateral and the main bore are cased and cemented at the junction. The junction provides full bore access to the lateral, and mechanical support is supplied by the tubulars and cement. However, because the cement can only withstand limited differential pressure, the junction does not provide hydraulic isolation.

TAML Level 5 wells do provide hydraulic isolation at the junction because pressure integrity is provided by the completion, which includes production tubing connecting a packer in the main wellbore above the junction and a packer in the lateral wellbore. Because hydraulic isolation and support are provided by the completion hardware, the junction may be a TAML Level 2, 3, or 4 before the Level 5 completion is installed.

TAML Level 6 wells also provide hydraulic isolation at the junction. A well at this level differs from a TAML Level 5 well in that pressure integrity is provided by the main wellbore casing and a cemented or uncemented liner in the lateral. The cost and complexity of creating a single-metal-element dual-bore casing junction downhole has prevented TAML Level 6 wells from being developed. As of today, the category exists as a result of early experiments. Because multilateral wells that have higher TAML designations are generally more complex, they are more costly, and their configurations are more flexible. As they do with multilateral geometry, engineers choose a TAML level junction based primarily on reservoir characteristics, costs, and function.

The ability to reenter the lateral for well intervention operations is another multilateral well design consideration. Because it is a directionally drilled section that has no junction, the lower lateral is almost always easily accessed using standard intervention methods. Operators must make an economics-based decision during the well planning stage to include junctions that allow lateral access after pulling the upper completion, through-tubing access, junctions that can be adopted to allow access after installation or junctions through which no access is possible to main bore, lateral, or both. If the well includes more than one lateral, a selective through-tubing access system would need to be considered. The decision to deploy lateral junctions that allow full bore or restricted access is a function of the overall well design. Engineers usually opt for full bore access if a packer is to be placed below the junction or if an artificial lift system must be located near the lower lateral. In addition, based on their knowledge of the reservoir, operators may require full bore access to perform perforating, stimulation, logging, water shutoff, gravel packing, cleanout, and other remedial operations. Full bore access can be adapted to all TAML level junctions but must be specified before installation; some commercially available junctions allow no access or only restricted access to either the lateral or the main bore and cannot be adapted after installation.

The decision to use a multilateral well system and what type to use are the result of cost-benefit analyses. In general, the less-complex junctions present operators with lower risks and costs. But risk mitigation and cost savings must be balanced against individual well and field development expectations. In low-value reservoirs, a simple open hole lateral that has no reentry capability may increase ultimate reserve recovery or accelerate production while having little impact on overall drilling and completion costs. In high-value deepwater plays, installing a hydraulically sealed TAML Level 5 or 6 junction can drive total well costs into millions of dollars and still be a good investment because it may save drilling another well with a complex and tortuous trajectory, preserve a well slot on an existing production platform, or eliminate the need entirely to procure and install additional subsea infrastructure.

In embodiments, a multilateral well is drilled and completed with a TAML Level 4 junction. The lower completion including the whipstock in the main bore and lateral liner are cemented. The upper completion includes a pump, a fluid separator, a crossflow packer, and a production packer. The pump, the fluid separator, the crossflow packer, and the production packer are in the lateral well according to embodiments of the present disclosure. The production packer can be above the junction between the lateral well and the main bore in some embodiments or below the junction in other embodiments. The production packer may be any packer capable of providing a seal between the outside of the production tubing and the inside of the casing. The pump includes any pump capable of drawing in fluid through the pump intake, pressurizing it, and lifting it to the surface such as an electrical submersible pump. The crossflow packer includes any sealing device capable of directing the formation fluid from the main bore to the separator in the lateral well and directing the oil from the separator in the lateral well to the surface.

FIG. 1 illustrates a fluid separator assembly disposed within a multilateral well, in accordance with some embodiments of the present disclosure. As illustrated, the multilateral well may include a Technology Advancement of Multilaterals (TAML) level 4 with re-entry packer allowing for the creation of a lateral well in existing wells or new wells. However, the multilateral well 100 may include any suitable type of multilateral well and completion. As illustrated, the multilateral well 100 may include a main bore 102 and at least one lateral bore 104. The lateral bore 104 may deviate from the main bore 102 at a junction 106. The junction 106 may include a portion of the main bore 102 from which the lateral bore 104 deviates from the main bore 102. As such, the junction 106 may be in direct fluid communication with the lateral bore 104 of the multilateral well 100.

Moreover, an orienting liner hanger 108 may be disposed in the main bore 102 of a multilateral well 100 in a position downhole from the junction 106. As illustrated, the orienting liner hanger 108 is secured to a portion of main bore casing 110 extending downhole from the junction 106. Further, the orienting liner hanger 108 may be sealed against the main bore casing 110 such that the orienting liner hanger 108 may fluidly isolate a portion of the main bore 102 proximate the junction 106 from a production portion 112 of the main bore 102. In particular, as set forth in greater detail below, the orienting liner hanger 108 may fluidly isolate a separator annulus 114 of the main bore 102 from the production portion 112 of the main bore 102.

The orienting liner hanger 108 may also be configured to support a lower completion 116. The lower completion 116 may be secured to a downhole end of the orienting liner hanger 108. As such, the lower completion assembly may also be disposed in the main bore of a multilateral well in a position downhole from the junction of the multilateral well. As illustrated, the lower completion 116 may extend into and through the production portion 112 of the main bore 102, which may produce formation fluid 118. The formation fluid 118 may include a combination of oil and water. Alternatively, the formation fluid 118 may include a combination of oil, gas, and water. The lower completion 116 may assist with directing and controlling flow of the formation fluid 118 from the production portion 112 of the main bore 102 toward a fluid separator 120 disposed uphole from the orienting liner hanger 108.

Moreover, the lower completion 116 may include a production zone tubing 122 and a plurality of production packers 124 disposed about the production zone tubing 122. The production packers 124 may be configured to isolate various production zones 126 (e.g., a first production zone 128, a second production zone 130, a third production zone 132, etc.) in the production portion 112 of the main bore 102. Further, the lower completion 116 may include at least one screen 134 disposed in each production zone 126 (e.g., between adjacent packers of the plurality of production packers 124). The at least one screen 134 is configured to filter and/or clean formation fluid 118 flowing into the production zone tubing 122. Indeed, formation fluid 118 is configured to enter the production zone tubing 122 via the at least one screen 134 and flow uphole toward the fluid separator.

The lower completion 116 may further include at least one flow control device 136 disposed between the at least one screen 134 and a central bore of the production zone tubing 122. The at least one flow control device 136 may be configured to control the flow rate of the formation fluid 118 into the production zone tubing 122. The at least one flow control device 136 may include any suitable flow control device. For example, the at least one flow control device 136 may include an inflow control device, an autonomous inflow control device, a density-based autonomous inflow control device, and any combination thereof. Further, the at least one flow control device 136 may be any valve operated automatically (autonomous inflow control device), manually, or remotely as part of an intelligent completion. The at least one flow control device 136 may control multiple production zones 126 selectively, reduce water and gas cuts, and maximize well productivity. The density-based autonomous inflow control devices may be any inflow control device capable of sensing the density difference between oil and water. For example, density-based autonomous inflow control device can use floats that are buoyant in water and sink in oil to control fluid production. Density-based autonomous inflow control device can control multiple production zones selectively, reduce water and gas cuts, and maximize well productivity.

As illustrated, the fluid separator 120 is configured to receive formation fluid 118 flowing uphole from the lower completion 116. The fluid separator 120 may be configured to receive the formation fluid 118 from the lower completion 116 via an inlet feature 138. The inlet feature 138 may be configured to seal against an inner surface of the orienting liner hanger 108. In particular, the inlet feature 138 may include an inlet tubular 140 having at least one seal 142 disposed about the inlet tubular 140. The inlet tubular 140 may be configured to extend into a portion of the orienting liner hanger 108 to form a seal between the inlet feature 138 and the inner surface of the orienting liner hanger 108. For example, with the inlet tubular 140 extended into the orienting liner hanger 108, the at least one seal 142 may compress between a radially outer surface of the inlet tubular 140 the inner surface of the orienting liner hanger 108 to form the seal.

The inlet feature 138 may be configured to fluidly connect the production zone tubing 122 with a fluid inlet (shown in FIG. 2) of the fluid separator 120 such that the formation fluid 118 may flow from the lower completion 116 into the fluid separator 120. Alternatively, as illustrated, at least one pump 144 may be disposed between the orienting liner hanger 108 and the fluid separator 120 such that the inlet feature 138 may be fluidly connected to the pump 144, and the pump 144 may be fluidly connected to the fluid separator 120. Moreover, the inlet feature 138 may also be configured to isolate the formation fluid 118 from the separator annulus 114, which may improve performance of the fluid separator assembly 146.

As set forth above, the formation fluid 118 may include a combination of oil and water. After receiving the formation fluid 118 from the lower completion 116, the fluid separator 120 is configured to at least partially separate the formation fluid 118 into formation oil 148 and formation water 150. Moreover, as set forth in greater detail below, the fluid separator 120 is configured to output formation oil 148 to flow uphole toward the surface, and output the formation water 150 to flow toward the lateral bore 104 of the multilateral well 100. For example, as illustrated, the fluid separator 120 may be configured to output the formation oil 148 into the separator annulus 114, which may fluidly connected to an upper production tubing 152 extending toward the surface such that the formation oil 148 may flow toward the surface. Additionally, the fluid separator 120 may be configured to output the formation water 150 into a lower production tubing 154, which may be fluidly connected to a junction annulus 156 that is in fluid connection with the lateral bore 104 such that the formation water 150 may flow toward the lateral bore 104.

As illustrated, an upper completion packer 158 may be secured within the main bore 102 in a position uphole from the junction 106. The upper completion packer 158 is configured to seal an uphole end 160 of the junction annulus 156 such that the formation water 150 flowing through the junction annulus 156 from the lower production tubing 154 may be directed into the lateral bore 104. The formation water 150 flowing into the lateral bore 104 may be directed to flow back into a subterranean formation 162. Directing the formation water 150 back into the subterranean formation 162 via the lateral bore 104 may eliminate the need to pump the formation water 150 to the surface for transportation and storage, which may improve efficiency and reduce the cost of completion operations.

Moreover, as illustrated, the fluid separator assembly 146 may include a dual string packer 164 secured within the main bore 102 in a position between the fluid separator 120 and the junction 106 of the multilateral well 100. That is, the dual string packer 164 may be configured to expand radially outward into the main bore casing 110 to form a seal. As such, the dual string packer 164 may be configured to fluidly isolate the junction annulus 156 from the separator annulus 114. As illustrated, the separator annulus 114 may be formed about the fluid separator 120 between the dual string packer 164 and the orienting liner hanger 108. Further, as set forth in greater detail below, the dual string packer 164 may be configured to receive the lower production tubing 154 and the upper production tubing 152. In particular, an uphole end 166 of the lower production tubing 154 may extending through the dual string packer 164 into the junction annulus 156, and a downhole end 168 of the upper production tubing 152 may extend through the dual string packer 164 into the separator annulus 114.

In particular, the upper production tubing 152 may extend at least from the separator annulus 114, through the dual string packer 164, and at least to the upper completion packer 158. As set forth above, the fluid separator 120 may be configured to output the formation oil 148 into the separator annulus 114. The downhole end 168 of the upper production tubing 152 may be open to the separator annulus 114. As such, the upper production tubing 152 may be configured to receive the formation oil 148 from the separator annulus 114 and direct the formation oil 148 to flow uphole toward the surface. As illustrated, the upper production tubing 152 may extend through junction annulus 156 to the upper completion packer 158 and continue past the upper completion packer 158 toward the surface. Alternatively, the upper production tubing 152 may extend to the upper completion packer 158 and a second upper production tubing 152 may extend from the upper completion packer 158 toward the surface.

As illustrated, the lower production tubing 154 has a downhole end coupled to fluid separator 120 such that the lower production tubing 154 is configured to receive the formation water 150 output from the fluid separator 120. The lower production tubing 154 extends from the fluid separator 120, through the dual string packer 164 and into the junction annulus 156. As such, the formation water 150 flowing into the lower production tubing 154 from the fluid separator 120 may be directed into the junction annulus 156. The junction annulus 156 is formed in the main bore 102 about the upper production tubing 152 between the dual string packer 164 and the upper completion packer 158. Further, as set forth above, the junction annulus 156 is sealed at the dual string packer 164 and the upper completion packer 158 such that the formation water 150 is directed to flow into the lateral bore 104, which is fluidly coupled to the junction annulus 156. As set forth above, the formation water 150 flowing into the lateral bore 104 may be directed to flow back into a subterranean formation 162, which may eliminate the need to pump the formation water 150 to the surface.

Moreover, a tubular swivel 170 may be disposed along the lower production tubing 154. In particular, an upper portion 172 of the lower production tubing 154 may be secured to an upper swivel portion 174 of the tubular swivel 170, and a lower portion 176 of the lower production tubing 152 may be secured to a lower swivel portion 178 of the tubular swivel 170. The lower swivel portion 178 is rotatable with respect to the upper swivel portion 174. Further, the fluid separator 120 may be connected to the lower swivel portion 178 via the lower portion of the lower production tubing 154. As such, the fluid separator 120 may be configured to rotate via rotation of the lower swivel portion 178. During operation, the fluid separator 120 may be configured to rotate to a gravitationally up position via the tubular swivel 170, such that the fluid separator 120 may effectively separate the formation fluid 118 into the formation oil 148 and the formation water 150.

The fluid separator assembly 146 may include a first water cut sensor 180 disposed uphole from the fluid separator 120. In particular, the first water cut sensor 180 may be disposed along the upper production tubing 152. As illustrated, the first water cut sensor 180 may be disposed along a portion of the upper production tubing 152 disposed in the junction annulus 156. The first water cut sensor 180 is configured to measure the water cut (e.g., the percentage of water) in the formation oil 148 flowing uphole toward the surface through the upper production tubing 152. Measurements from the first water cut sensor 180 (e.g., water cut data) may be output to a controller 184 (e.g., a downhole controller 186 and/or a surface controller 188), which may output instructions based at least in part on the measurements.

The fluid separator assembly 146 may further include a second water cut sensor 182 disposed downhole from the fluid separator 120. As illustrated, the second water cut sensor 182 may be disposed along the production zone tubing 122. However, the second water cut sensor 182 may be disposed in any suitable position between the fluid separator 120 and the lower completion 116. The second water cut sensor 182 is configured to measure the percentage of water in the formation fluid 118 flowing from the lower completion 116 toward the fluid separator 120. Measurements from the first water cut sensor 180 and the second water cut sensor 182 may be output to the controller 184, which may determine an effectiveness of the fluid separator 120 based at least in part on a difference between the measurements from the first water cut sensor 180 (e.g., after the fluid separator 120) and the second water cut sensor 182 (e.g., before the fluid separator 120).

The fluid separator assembly 146 may include a third water cut sensor 190 disposed uphole from the fluid separator 120. In particular, the third water cut sensor 190 may be disposed along the lower production tubing 154 to measure the water cut of the formation water 150. That is, the third water cut sensor 190 may be configured to measure the percentage of water in the formation water 150 to determine how much oil remains in the formation water 150. Ideally, the oil and the water from the formation fluid 118 are completely separated in the fluid separator 120. However, in some cases, the oil and the water may not completely separate. As such, the term formation oil 148 may refer to a combination of oil and water having at least 70% oil. Further, the term formation water 150 may refer to a combination of water and oil having at least 70% water. Moreover, measurements from the first water cut sensor 180, the second water cut sensor 182, and/or the third water cut sensor 190 may be output to the controller 184. The controller 184 may be configured to compare the measurements from the first water cut sensor 180 and the third water cut sensor 190 to determine if leaks are present in the main bore casing 110, the dual string packer 164, the orienting liner hanger 108, and/or any other feature configured to isolate the formation oil 148, the formation water 150, and the formation fluid 118 from each other.

As set forth above, the controller 184 may be configured to receive water cut sensor data from at least one of the water cut sensors (e.g., the first water cut sensor 180, the second water cut sensor 182, and/or the third water cut sensor 190). The controller 184 may be configured to output instructions to adjust a flow rate of the formation fluid 118 flowing into the fluid separator 120 based at least in part on the water cut sensor data. For example, the fluid separator assembly 146 may include at least one pump 144 configured to drive the formation fluid 118 into the fluid separator 120 from the lower completion 116. The at least on pump 144 may be configured to adjust the flow rate of the formation fluid 118 into the fluid separator 120 in response to instructions received from the controller 184. Moreover, as set forth in greater detail below, the fluid separator 120 assembly may include additional or alternative sensors. The controller 184 may be configured to output instructions to the at least one pump 144 based data from any single sensor and/or combination of sensors.

The fluid separator assembly 146 may include a first pressure sensor 192 disposed within the upper production tubing 152 and a second pressure sensor 194 disposed within the junction annulus 156 about the upper production tubing 152. The first pressure sensor 192 is configured to measure the pressure of the formation oil 148 flowing through the upper production tubing 152, and the second pressure sensor 194 is configured to measure the pressure of the formation water 150 in the junction annulus 156. The controller 184 may be configured to receive the pressure measurements from the first pressure sensor 192 and/or the second pressure sensor 194 to determine the effectiveness of the fluid separator 120. Further, the controller 184 may be configured to output instructions to the pump 144 to control a flow rate of the pump 144 based at least in part on the determined effectiveness of the fluid separator 120. For example, the controller 184 may be configured to output instructions to the pump 144 to reduce the flow rate in response to inadequate separation of the formation fluid 118 into the formation water 150 and the formation oil 148

The fluid separator assembly 146 may include a first temperature sensor 196 disposed within the upper production tubing 152 and a second temperature sensor 198 disposed within the junction annulus 156 about the upper production tubing 152. The first temperature sensor 196 is configured to measure the temperature of the formation oil 148 passing through the upper production tubing 152, and the second temperature sensor 198 is configured to measure the temperature of the formation water 150 in the junction annulus 156. The controller 184 may be configured to receive the temperature measurements from the first temperature sensor 196 and/or the second temperature sensor 198 to determine the effectiveness of the fluid separator 120. Further, the controller 184 may be configured to output instructions to the pump 144 to control a flow rate of the pump 144 based at least in part on the determined effectiveness of the fluid separator 120. Indeed, as set forth above, the controller 184 may be configured to output instructions to the pump 144 to reduce the flow rate in response to inadequate separation of the formation fluid 118 into the formation water 150 and the formation oil 148. Moreover, the controller 184 may be configured to determine the effectiveness of the fluid separator 120 based on a combination of the temperature measurements and the pressure measurements.

The fluid separator assembly 146 may further include an acoustic fiber optic sensor 101 for distributed acoustic sensing. The acoustic fiber optic sensor 101 may extend through at least a portion of a junction annulus 156 formed in the main bore 102 proximate the junction 106. However, the acoustic fiber optic sensor 101 may be disposed in any suitable location in the multilateral well 100. For example, the acoustic fiber optic sensor 101 may be disposed in the main bore 102, the lateral bore 104 or some combination thereof. Further, the acoustic fiber optic sensor 101 may be located above and/or below the junction 106 of the multilateral well 100.

Further, the fluid separator assembly 146 may include at least one temperature fiber optic sensor 103 for distributed temperature sensing. Similarly, the temperature fiber optic sensor 103 may extend through at least a portion of a junction annulus 156 formed in the main bore 102 proximate the junction 106. However, the temperature fiber optic sensor 103 may be disposed in any suitable location in the multilateral well 100. For example, the temperature fiber optic sensor 103 may be disposed in the main bore 102, the lateral bore 104 or some combination thereof. Further, the temperature fiber optic sensor 103 may be located above and/or below the junction 106 of the multilateral well 100.

Additionally, as set forth in greater detail below the fluid separator assembly 146 may further include a sampler 105 configured to output formation water samples to the surface for testing such that the effectiveness of the fluid separator 120 may be determined. Based at least in part on testing results from the formation water samples, the controller (e.g., the surface controller 188) may be configured to output instructions to adjust the pump 144 and/or other control devices, which may increase the effectiveness of the fluid separator 120. For example, in response to low separation values (e.g., ineffective separation), the controller 184 may output instructions to the pump 144 to reduce the flow rate of the formation fluid such that the fluid separator 120 may better separate the formation fluid 118 into the formation oil 148 and the formation water 150.

Moreover, the fluid separator assembly 146 may include a neural network 107 configured generate a flow model based at least in part on sensor data received from various sensors (e.g., the first temperature sensor 196, the second temperature sensor 198, the first pressure sensor 192, the second pressure sensor 194, the first water cut sensor 180, the second water cut sensor 182, etc.). The flow model may represent downhole conditions, as well as the efficiency of fluid separation via the fluid separator assembly 146. Moreover, the neural network 107 may be configured to output instructions to modulate the power supplied to the pump 144 to control a flow rate of fluids (e.g., the formation fluid 118, the formation oil 148, and/or the formation water 150) through the fluid separator 120, flow of the formation oil 150 to the surface, and flow of the formation water 150 being injected into the lateral bore 104. The neural network 107 may be configured to update the flow model based on real time data received from the various sensor data, torque data, power consumption data for the pump 144, or some combination thereof. Updating the flow model may improve efficiency of the fluid separator assembly 146.

Figure 2:
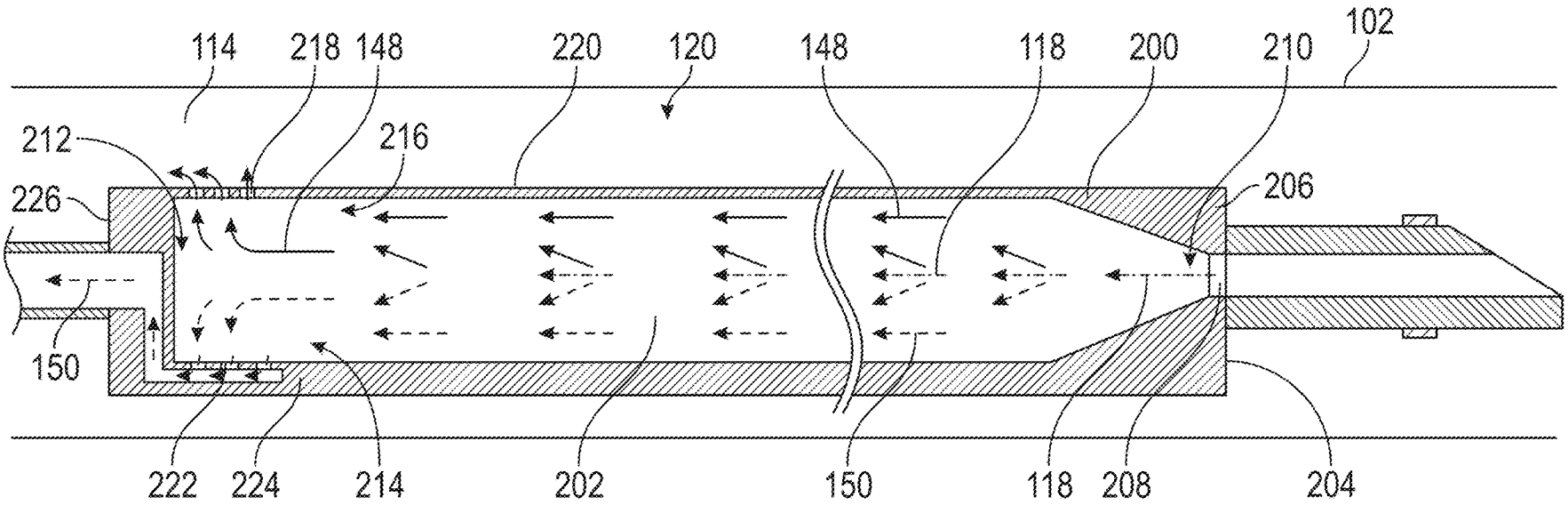
FIG. 2 illustrates a cross-sectional view of a fluid separator, in accordance with some embodiments of the present disclosure.

FIG. 2 illustrates a cross-sectional view of a fluid separator, in accordance with some embodiments of the present disclosure. As illustrated, the fluid separator 120 may include a separator housing 200 and an elongated fluid chamber 202 formed within the separator housing 200. Further, a downhole end 204 of the separator housing 200 may include a lower end wall 206 with a fluid inlet 208 extending through the lower end wall 206 to the elongated fluid chamber 202. As such, the fluid separator 120 may be configured to receive the formation fluid 118 from the lower completion 116 (shown in FIG. 1) through the fluid inlet 208. In particular, the formation fluid 118 may flow into a downhole end 210 of the elongated fluid chamber 202 via the fluid inlet 208. The formation fluid 118 may continue to flow through the elongated fluid chamber 202 from the downhole end 210 toward an uphole end 212 of the elongated fluid chamber 202. The elongated fluid chamber 202 may include any suitable length.

As the formation fluid 118 flows through the elongated fluid chamber 202, the formation fluid 118 may gradually separate into the formation oil 148 and the formation water 150 in response to gravitational forces. The formation water 150 may have a higher density than the formation oil 148. Further, oil and water are immiscible. Accordingly, the formation oil 148 and the formation water 150 may separate due to gravitational forces as the formation fluid 118 flows through the elongated fluid chamber 202. As illustrated, the formation water 150 may fall toward a bottom portion 214 of the elongated fluid chamber 202 since the formation water 150 has a higher density than the formation oil 148. For the same reasons, the formation oil 148 may rise toward a top portion 216 of the elongated fluid chamber 202. Ideally, the oil and the water from the formation fluid 118 are completely separated upon reaching the downhole end 210 of the elongated fluid chamber 202. However, as set forth above, the oil and the water may not completely separate. As such, the term formation oil 148 may refer to a combination of oil and water having at least 70% oil. Further, the term formation water 150 may refer to a combination of water and oil having at least 70% water.

Further, an oil outlet 218 may be formed in a top portion 220 of the separator housing 200. In particular, the oil outlet 218 may be formed in a top surface of the elongated fluid chamber 202 in a position proximate to the uphole end 212 of the elongated fluid chamber 202. The fluid separator 120 may be positioned and oriented within the main bore 102 such that the top portion 220 of the separator housing 200 is oriented with respect to gravity. Further, the separator housing 200 may be disposed within a horizontal portion of the main bore 102. Moreover, the oil outlet 218 is in fluid communication with the elongated fluid chamber 202 such that the formation oil 148 may flow into the oil outlet 218 from the elongated fluid chamber 202 after separating from the formation water 150. Further, as illustrated, the oil outlet 218 may be configured to output the formation oil 148 from separator housing 200 into the separator annulus 114 such that the formation oil 148 may flow through the separator annulus 114 to the upper production tubing 152.

Moreover, a water outlet 222 may be formed in a bottom portion 224 of the separator housing 200. In particular, the water outlet 222 may be formed in a bottom surface of the elongated fluid chamber 202 in a position proximate to the uphole end 212 of the elongated fluid chamber 202. The water outlet 222 is in fluid communication with the elongated fluid chamber 202 such that the formation water 150 may flow into the water outlet 222 from the elongated fluid chamber 202 after separating from the formation oil 148. Further, as illustrated, the water outlet 222 may extend to an upper axial end 226 of the separator housing 200 such that the water outlet 222 may be configured to output the formation water 150 into the lower production tubing 154.

Figure 3:
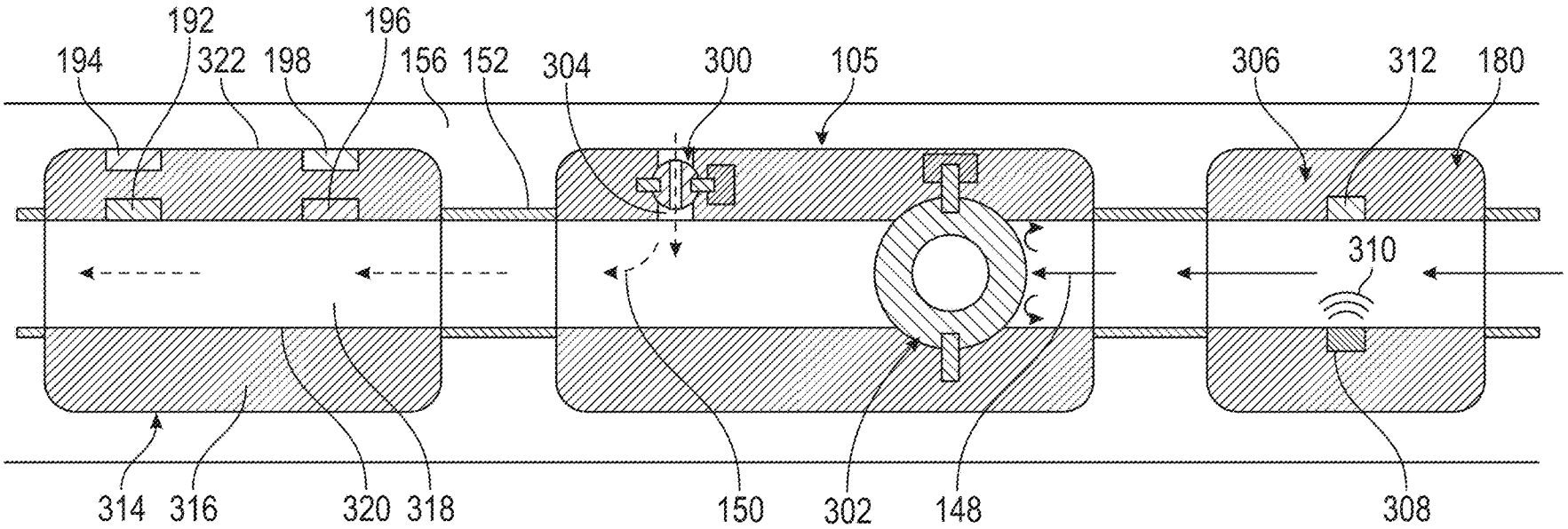
FIG. 3 illustrates a cross-sectional view of a sampler, water cut sensor, and gauge mandrel of a fluid separator assembly, in accordance with some embodiments of the present disclosure.

FIG. 3 illustrates a cross-sectional view of a sampler, water cut sensor, and gauge mandrel of a fluid separator assembly, in accordance with some embodiments of the present disclosure. The sampler 105 may be disposed along the portion of the upper production tubing 152 in the junction annulus 156. As illustrated, the sampler 105 may include an upper valve 300 and a lower valve 302. The upper valve 300 is disposed uphole from the lower valve 302 such that the upper valve 300 may be disposed between the lower valve 302 and the upper completion packer 158. The lower valve 302 is configured to selectively block flow of the formation oil 148 through the upper production tubing 152 to initiate a sampling process of the sampler 105. Further, the upper valve 300 is configured to open a sampler flow path 304 from the junction annulus 156 to the upper production tubing 152 in response to the lower valve 302 blocking flow of the formation oil 148 through the upper production tubing 152 at the sampler 105. With the formation oil 148 blocked from flowing uphole, the formation water 150 flowing into the upper production tubing 152 (i.e., uphole from the lower valve 302) via the upper valve 300 may flow to the surface via the upper production tubing 152 such that a sample of the formation water 150 in the junction annulus 156 may be taken and analyzed at the surface.

As illustrated, the fluid separator assembly 146 may include at least one water cut sensor 306 (e.g. the first water cut sensor 180) to determine the percentage of water in the formation oil 148. The water cut sensor 306 may be configured to make dielectric measurements using radio or microwave frequency and infrared measurements to determine the water cut. For example, as illustrated, the water cut sensor 306 may include at least a transmitter 308 for outputting a signal 310 (e.g., radio, microwave, infrared, etc.) into the formation oil 148 flowing through the upper production tubing 152. The water cut sensor 306 may further include a receiver 312 for receiving the signal 310 output through the formation oil 148. The water cut sensor 306 may be configured to determine the percentage of water in the formation oil 148 based on the received signal 310. Alternatively, or additionally, the water cut sensor 306 may use gamma ray based instruments to determine the water cut.

Moreover, the fluid separator assembly 146 may include a gauge mandrel 314 configured to house the first pressure sensor 192, the second pressure sensor 194, the first temperature sensor 196, and/or the second temperature sensor 198. The gauge mandrel 314 may include a tubular gauge housing 316 configured to be installed in line with the upper production tubing 152. Alternatively, the tubular gauge housing 316 may be installed in line with the lower production tubing 154. Moreover, as illustrated, the tubular gauge housing 316 includes a central gauge bore 318 such that the formation oil 148 may flow through the gauge mandrel 314. As set forth above, the first pressure sensor 192 is configured to measure the pressure of the formation oil 148 flowing through the upper production tubing 152. Accordingly, the first pressure sensor 192 may be disposed at a radially inner surface 320 of the tubular gauge housing 316. Further, the second pressure sensor 194 may be disposed at a radially outer surface 322 of the tubular gauge housing 316 such that the second pressure sensor 194 may measure the pressure of the formation water 150 in the junction annulus 156. Additionally, the first temperature sensor 196 may be disposed at the radially inner surface 320 of the tubular gauge housing 316 to measure the temperature of the formation oil 148 passing through the upper production tubing 152, and the second temperature sensor may be disposed at the radially outer surface 322 of the tubular gauge housing 316 to measure the temperature of the formation water 150 in the junction annulus 156.

Figure 4:
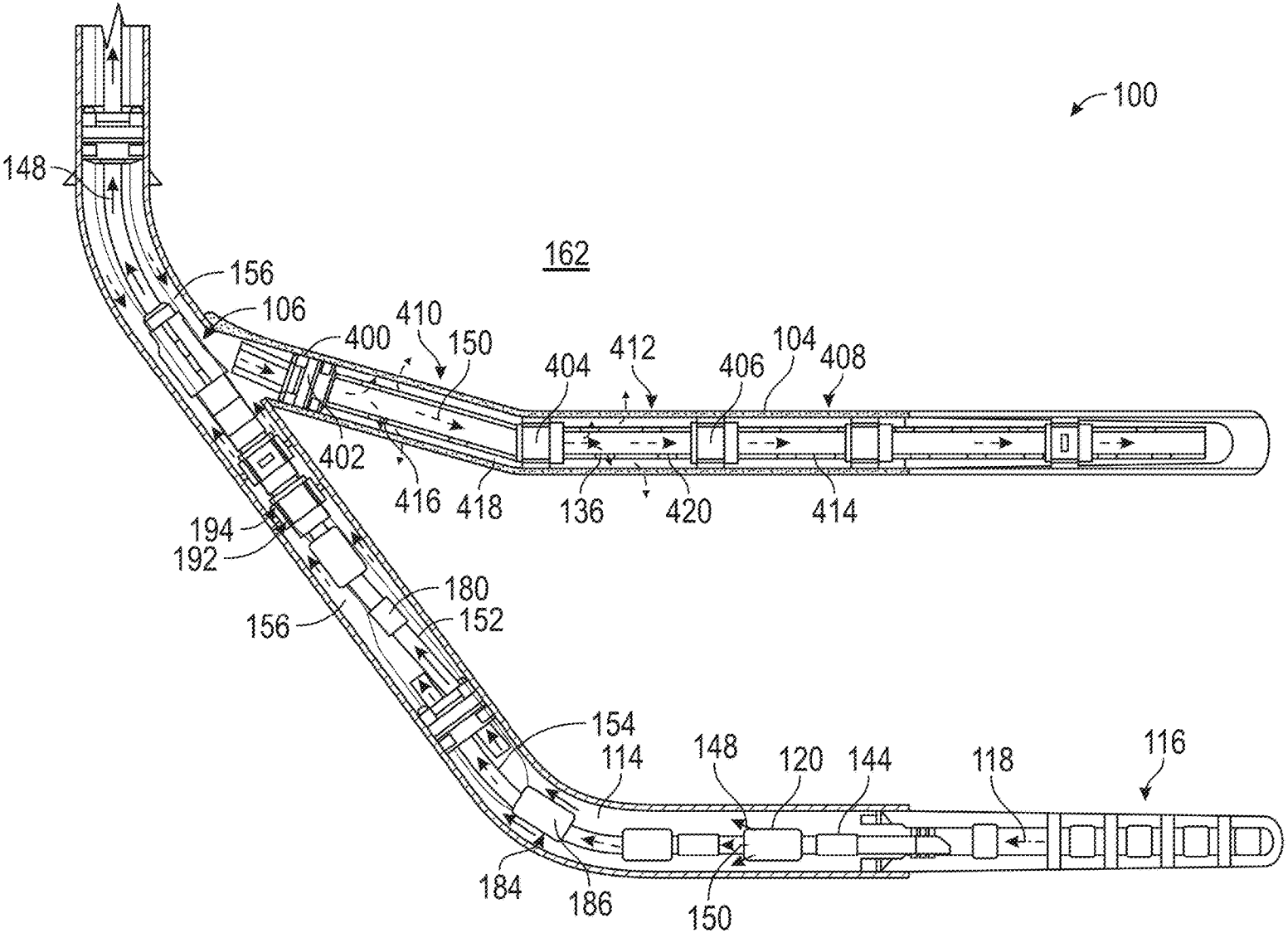
FIG. 4 illustrates a fluid separator assembly having flow control devices disposed in the lateral bore, in accordance with some embodiments of the present disclosure.

FIG. 4 illustrates a fluid separator assembly having flow control devices disposed in the lateral bore, in accordance with some embodiments of the present disclosure. As set forth above, the fluid separator 120 is configured to receive formation fluid 118 flowing uphole from the lower completion 116. After receiving the formation fluid 118 from the lower completion 116, the fluid separator 120 is configured to at least partially separate the formation fluid 118 into the formation oil 148 and the formation water 150. Moreover, the fluid separator 120 is configured to output the formation oil 148 to flow uphole toward the surface via the separator oil outlet 218 and output the formation water 150 to flow toward the lateral bore 104 of the multilateral well 100 via the separator water outlet 222 (shown in FIG. 2).

For example, as illustrated, the fluid separator 120 may be configured to output the formation oil 148 into the separator annulus 114, which may be fluidly connected to an upper production tubing 152 extending toward the surface. As such, the formation oil 148 may flow through the separator annulus 114 to the upper production tubing 152 and continue to flow through the upper production tubing 152 toward the surface. Additionally, the fluid separator 120 may be configured to output the formation water 150 into a lower production tubing 154, which may be fluidly connected to the junction annulus 156. Further, as illustrated the junction annulus 156 may be fluidly connected to the lateral bore 104. As such, the formation water 150 output by the fluid separator 120 may flow through the lower production tubing 154 and into the junction annulus 156. Subsequently, the formation water 150 may flow from the junction annulus 156 into the lateral bore 104.

The fluid separator assembly 146 may include at least one lateral bore packer (e.g., a first lateral bore packer 400) disposed within the lateral bore 104 proximate the junction 106. The formation water 150 may flow into the lateral bore 104 via a central bore of the first lateral bore packer 400. Further, the first lateral bore packer 400 may include a one way valve 402. The one way valve 402 may be positioned in the central bore of the first lateral bore packer 400 to permit the formation water 150 to flow from the junction annulus 156 into the lateral bore 104 but block the formation water 150 from flowing from the lateral bore 104 back into the junction annulus 156. The one way valve 402 may include any suitable type of valve. For example, the one way valve 402 may include a flapper valve, a ball check valve, etc.

The fluid separator assembly 146 may further include additional lateral bore packers (e.g., a second lateral bore packer 404, a third lateral bore packer 406, etc.) disposed within the lateral bore 104 to isolate various distribution zones 408 (e.g., a first distribution zone 410, a second distribution zone 412, etc.) in the lateral bore 104. Lateral bore tubing 414 may extend between adjacent lateral bore packers. Further, at least one flow control device 136 may be disposed in the respective lateral bore tubing 414 of each distribution zone 408. For example, a first lateral bore flow control device 416 may be secured to a first lateral bore tubing 414 in the first distribution zone 410 to permit the formation water 150 to flow from the first lateral bore tubing 414 into a first lateral bore annulus 418. The first lateral bore annulus 418 may be formed about the first lateral bore tubing 414 between the first lateral bore packer 400 and the second lateral bore packer 404. As set forth in greater detail below, the first lateral bore flow control device 416 may be adjustable to control the flow rate of formation water 150 flowing into the first lateral bore annulus 418. Moreover, the formation water 150 flowing into the first lateral bore annulus 418 may be configured to flow back into the subterranean formation 162 surrounding the first lateral bore annulus 418. As set forth above, directing the formation water 150 back into the subterranean formation 162 via the lateral bore 104 may eliminate the need to pump the formation water 150 to the surface for transportation and storage, which may improve efficiency and reduce the cost of completion operations.

Further, as set forth above, the lateral bore 104 may be separated into the various distribution zones (e.g., the first distribution zone 410, the second distribution zone 412, etc.), each having respective flow control devices 136, such that the formation water 150 may be selectively distributed into the various distribution zones 408 of the lateral bore 104. That is, the formation water 150 may be configured to enter the lateral bore 104 via the first lateral bore packer 400 and continue to flow along a pathway through the respective lateral bore packers and lateral bore tubing 414 toward a downhole end of the lateral bore 104. As the formation water 150 flows through the lateral bore tubing 414 of each distribution zone 408, a portion of the formation water 150 may be output through each of the respective flow control devices 136 into the corresponding lateral bore annuli. The respective flow control devices 136 may be individually adjusted. For example, the first lateral bore flow control device 416 may be choked more than a second lateral bore flow control device 420 such that a greater amount of formation water 150 is output into the second distribution zone 412 than the first distribution zone 410.

Moreover, as set forth above, the fluid separator assembly 146 may include at least one sensor configured to measure various properties of the formation oil 148 and the formation water 150 output from the fluid separator 120. For example, the fluid separator assembly 146 may include the first water cut sensor 180 configured to determine the percentage of water in the formation oil 148 flowing through the upper production tubing 152. Alternatively, or additionally, the fluid separator 120 may include the first pressure sensor 192 to measure the pressure of the formation oil 148 in the upper production tubing 152 and the second pressure sensor 194 to measure the pressure of the formation water 150 in the junction annulus 156.

The fluid separator assembly 146 may include the controller 184 (e.g. the downhole controller 186 and/or the surface controller 188) configured to receive sensor data from the at least one sensor (e.g., the first water cut sensor 180, the first pressure sensor 192, the second pressure sensor 194, etc.). The controller 184 may be configured to output instructions to adjust the flow rate of the formation fluid 118 flowing into the lateral bore 104 based at least in part on the sensor data. For example, as set forth above, the fluid separator assembly 146 may include the at least one pump 144 configured to drive the formation fluid 118, the formation oil 148, and/or the formation water 150 through the main bore 102 and/or lateral bore 104. The at least on pump 144 may be configured to adjust the flow rate of the formation fluid 118, the formation oil 148, and/or the formation water 150 in response to instructions received from the controller 184.

Moreover, the controller 184 may be configured to output instructions to the at least one flow control device 136 (e.g., the first lateral bore flow control device 416, the second lateral bore flow control device 420, etc.) to adjust the flow rate of the formation water 150 flowing into the lateral bore 104. That is, the at least one flow control device 136 may be configured to selectively increase or decrease flow through the at least one flow control device 136 in response to instructions from the controller 184 such that the flow rate of the formation water 150 flowing into the lateral bore 104 may be controlled.

Figure 5:
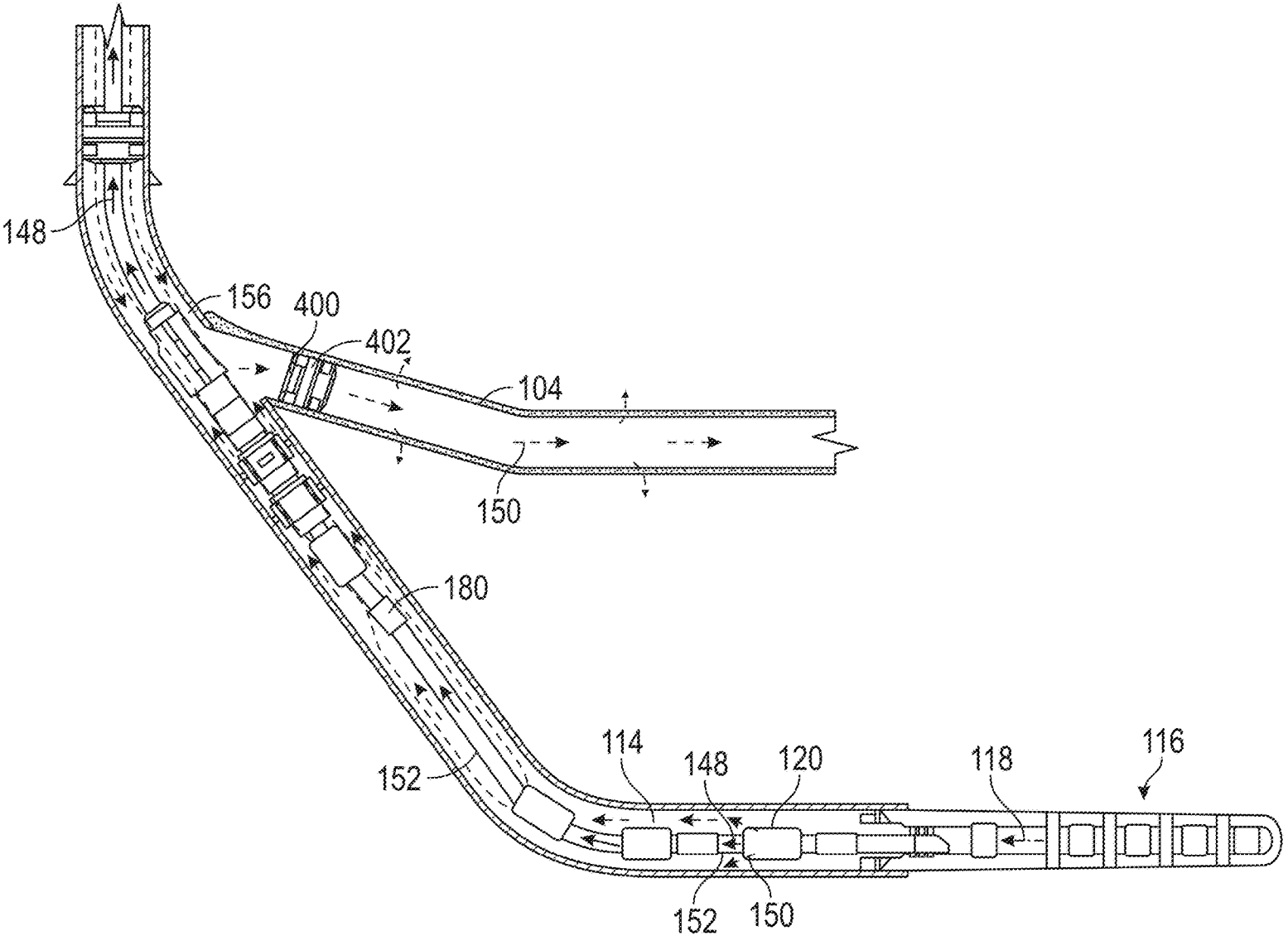
FIG. 5 illustrates a fluid separator configured to output formation oil directly into an upper production tubing and formation water directly into an annulus of the main bore, in accordance with some embodiments of the present disclosure.

FIG. 5 illustrates a fluid separator configured to output formation oil directly into an upper production tubing and formation water directly into an annulus of the main bore, in accordance with some embodiments of the present disclosure. As set forth above, after receiving the formation fluid 118 from the lower completion 116, the fluid separator 120 may be configured to at least partially separate the formation fluid 118 into formation oil 148 and formation water 150. Moreover, as set forth in greater detail below, the fluid separator 120 is configured to output formation oil 148 and the formation water 150. As illustrated, the fluid separator 120 may be configured to output the formation oil 148 directly into the upper production tubing 152. Further, the fluid separator 120 may be configured to output the formation water 150 into the separator annulus 114, which is fluidly connected to the junction annulus 156. As such, the formation water 150 output from the fluid separator 120 may flow through the separator annulus 114, through the junction annulus 156, and into the lateral bore 104. As set forth above, the lateral bore 104 may include the lateral bore packer (e.g., the first lateral bore packer 400) having the one way valve 402 such that the formation water 150 flowing into the lateral bore 104 via the junction annulus 156 may not flow back into the junction annulus 156 from the lateral bore 104.

Moreover, the fluid separator assembly 146 may include at least one sensor disposed along the upper production tubing 152 to determine various properties of the formation oil 148 and/or the formation water 150 output from the fluid separator 120. For example, the first water cut sensor 180 may be disposed along the upper production tubing 152 to determine the percentage of water in the formation oil 148 flowing through the upper production tubing 152. Further, as set forth above, the fluid separator assembly 146 may be configured to adjust the flow rate of the formation fluid 118 flowing into the fluid separator 120, the flow rate of the formation oil 148 in the upper production tubing 152, and or the flow rate of the formation water 150 in response to the sensor data to increase effectiveness of the fluid separator 120.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. The systems and methods may comprise any of the various features disclosed herein, comprising one or more of the following statements.

Statement 1. A system comprising: a lower completion disposed in a main bore of a multilateral well in a position downhole from a junction of the multilateral well; a fluid separator configured to receive formation fluid flowing from the lower completion, wherein the formation fluid includes oil and water, wherein the fluid separator is configured to at least partially separate the formation fluid into formation oil and formation water, wherein the fluid separator is configured to output formation oil, via a separator oil outlet, to flow uphole, and wherein the fluid separator is configured to output the formation water, via a separator water outlet, to flow toward a lateral bore of the multilateral well; and a water cut sensor disposed uphole from the fluid separator, wherein the water cut sensor is configured to measure the percentage of water in the formation oil.

Statement 2. The system of statement 1, further comprising a controller configured to receive water cut sensor data from the water cut sensor, and wherein the controller is configured to output instructions to adjust a flow rate of the formation fluid flowing into the fluid separator based at least in part on the water cut sensor data.

Statement 3. The system of statement 1 or statement 2, further comprising a second water cut sensor disposed downhole from the fluid separator, wherein the second water cut sensor is configured to measure the percentage of water in the formation fluid.

Statement 4. The system of any preceding statement, further comprising: a dual string packer secured within the main bore in a position between the fluid separator and the junction of the multilateral well, wherein the dual string packer is configured to fluidly isolate a junction annulus from a separator annulus, wherein the separator annulus is formed about the fluid separator; an upper completion packer secured within the main bore in a position uphole from the junction, wherein the upper completion packer seals an uphole end of the junction annulus; and an upper production tubing extending at least from the separator annulus, through the dual string packer, and at least to the upper completion packer, wherein the upper production tubing is configured to direct the formation oil from the separator annulus to flow uphole through the upper completion packer toward the surface.

Statement 5. The system of any preceding statement, further comprising a lower production tubing having a downhole end coupled to the separator water outlet, wherein the lower production tubing extends through the dual string packer and into the junction annulus to direct the formation water into the junction annulus, wherein the junction annulus is formed in the main bore about the upper production tubing between the dual string packer and the upper completion packer, wherein the junction annulus is fluidly coupled to the lateral bore such that formation water output into the junction annulus is directed to flow into the lateral bore from the junction annulus.

Statement 6. The system of any preceding statement, further comprising a tubular swivel having an upper portion and a lower portion, wherein the lower portion is rotatable with respect to the upper portion, wherein the fluid separator is connected to the lower portion, and wherein the fluid separator is configured to rotate to a gravitationally up position via rotation of the lower portion of the tubular swivel.

Statement 7. The system of any preceding statement, further comprising a first pressure sensor disposed within an upper production tubing and a second pressure sensor disposed within a junction annulus about the upper production tubing, wherein the first pressure sensor is configured to measure the pressure of the formation oil passing through the upper production tubing, and wherein the second pressure sensor is configured to measure the pressure of the formation water in the junction annulus.

Statement 8. The system of any preceding statement, further comprising a first temperature sensor disposed within an upper production tubing and a second temperature sensor disposed within a junction annulus about the upper production tubing, wherein the first temperature sensor is configured to measure the temperature of the formation oil passing through the upper production tubing, and wherein the second temperature sensor is configured to measure the temperature of the formation water in the junction annulus.

Statement 9. The system of any preceding statement, further comprising at least one fiber optic sensor for distributed acoustic sensing, wherein the fiber optic sensor extends through at least a portion of a junction annulus formed in the main bore proximate the junction.

Statement 10. The system of any preceding statement, further comprising at least one fiber optic sensor for distributed temperature sensing, wherein the fiber optic sensor extends through at least a portion of a junction annulus formed in the main bore proximate the junction.

Statement 11. The system of any preceding statement, further comprising at least one pump configured to drive the formation fluid into the fluid separator from the lower completion, wherein the at least on pump is configured to adjust a flow rate of the formation fluid into the fluid separator in response to instructions received from a controller, wherein the controller is configured to output instructions based at least in part on received sensor data.

Statement 12. The system of any preceding statement, further comprising lateral bore packer disposed within the lateral bore proximate the junction, a lateral bore tubing extending from the lateral bore packer and into the lateral bore, and at least one flow control device, wherein the at least one flow control device is configured to adjust a flow rate of the formation water flowing into the lateral bore from the lateral bore tubing in response to instructions received from a controller, wherein the controller is configured to output instructions based at least in part on received sensor data.

Statement 13. The system of any preceding statement, further comprising a sampler having an upper valve and a lower valve, wherein the sampler is disposed between the fluid separator and an upper completion packer, wherein the lower valve is configured to selectively block flow of the formation oil through an upper production tubing, wherein the upper valve is disposed between the lower valve and the upper completion packer, and wherein the upper valve is configured to open a flow path from a junction annulus to the upper production tubing in response to the lower valve blocking flow of the formation oil through the upper production tubing such that the formation water may flow to the surface via the upper production tubing for sampling.

Statement 14. The system of any preceding statement, further comprising a neural network configured to generate a flow model based at least in part on sensor data received from at least the water cut sensor, wherein the neural network is configured to output instructions to adjust a flow rate of the formation fluid flowing into the fluid separator based at least in part on the water cut sensor data, and wherein the neural network is configured to update the flow model in real-time based on additional sensor data received from at least the water cut sensor.

Statement 15. The system of any preceding statement, wherein the lower completion includes at least one flow control device, wherein the at least one flow control device is selected from the group consisting of an inflow control device, an autonomous inflow control device, a density-based autonomous inflow control device, and any combination thereof.

Statement 16. A system comprising: an orienting liner hanger disposed in a main bore of a multilateral well in a position downhole from a junction of the multilateral well; a lower completion assembly secured to a downhole end of the orienting liner hanger; a fluid separator configured to receive formation fluid flowing from the lower completion assembly, wherein the formation fluid includes oil and water, wherein the fluid separator is configured to at least partially separate the formation fluid into formation oil and formation water, wherein the fluid separator is configured to output formation oil into a separator annulus via a separator oil outlet, and wherein the fluid separator is configured to output the formation water, via a separator water outlet, to flow toward a lateral bore of the multilateral well; a dual string packer secured within the main bore in a position between the fluid separator and the junction of the multilateral well; an upper completion packer secured within the main bore in a position uphole from the junction; an upper production tubing extending at least from the separator annulus, through the dual string packer, and to the upper completion packer, wherein the upper production tubing is configured to direct the formation oil from the separator annulus to flow uphole through the upper completion packer; a lower production tubing having a downhole end coupled to the separator water outlet, wherein the lower production tubing extends through the dual string packer and into the junction annulus to direct the formation water into the junction annulus, wherein the junction annulus is formed in the main bore about the upper production tubing between the dual string packer and the upper completion packer, wherein the junction annulus is fluidly coupled to the lateral bore such that formation water output into the junction annulus is directed to flow into the lateral bore from the junction annulus; and a water cut sensor disposed uphole from the fluid separator, wherein the water cut sensor is configured to measure the percentage of water in the formation oil flowing through the upper production tubing.

Statement 17. The system of statement 16, further comprising a lateral bore packer disposed within the lateral bore proximate the junction, a lateral bore tubing extending from the lateral bore packer and into the lateral bore, and at least one flow control device, wherein the at least one flow control device is configured to adjust a flow rate of the formation water flowing into the lateral bore from the lateral bore tubing in response to instructions received from a controller, wherein the controller is configured to output instructions based at least in part on water cut data received from the water cut sensor.

Statement 18. The system of statement 16 or statement 17, wherein the lateral bore packer includes a one way valve, wherein the one way valve is configured to prevent the formation water from flowing into the junction annulus from the lateral bore tubing, and wherein the lateral bore packer is configured to seal against the lateral bore to prevent the formation water from flowing into the junction annulus from an annulus of the lateral bore formed about the lateral bore tubing.

Statement 19. The system of any of statements 16-18, further comprising a first pressure sensor disposed within the upper production tubing and a second pressure sensor disposed within the junction annulus about the upper production tubing, wherein the first pressure sensor is configured to measure the pressure of the formation oil passing through the upper production tubing, and wherein the second pressure sensor is configured to measure the pressure of the formation water in the junction annulus.

Statement 20. A method, comprising: drawing formation fluid into a lower completion tubing positioned in a production zone of a main bore of a multilateral well; pumping the formation fluid into a fluid separator via at least one pump, wherein the fluid separator is disposed uphole from the production zone; separating the formation fluid into formation oil and formation water via the fluid separator; drawing the formation oil up hole to a surface through an upper production tubing; injecting the formation water from the fluid separator into a lateral bore of the multilateral well; determining the percentage of water in the formation oil flowing through the upper production tubing via at least one sensor disposed uphole from the fluid separator; and adjusting a rate of injection of the formation water into the lateral bore based at least in part on the determined percentage of water in the formation oil.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A system comprising:

a lower completion disposed in a main bore of a multilateral well in a position downhole from a junction of the multilateral well;

a fluid separator configured to receive formation fluid flowing from the lower completion, wherein the formation fluid includes oil and water, wherein the fluid separator is configured to at least partially separate the formation fluid into formation oil and formation water, wherein the fluid separator is configured to output the formation oil, via a separator oil outlet, to flow uphole, and wherein the fluid separator is configured to output the formation water, via a separator water outlet, to flow toward a lateral bore of the multilateral well;

a water cut sensor disposed uphole from the fluid separator, wherein the water cut sensor is configured to measure the percentage of water in the formation oil;

a dual string packer secured within the main bore in a position between the fluid separator and the junction of the multilateral well, wherein the dual string packer is configured to fluidly isolate a junction annulus from a separator annulus, wherein the separator annulus is formed about the fluid separator;

an upper completion packer secured within the main bore in a position uphole from the junction, wherein the upper completion packer seals an uphole end of the junction annulus; and an upper production tubing extending at least from the separator annulus, through the dual string packer, and at least to the upper completion packer, wherein the upper production tubing is configured to direct the formation oil from the separator annulus to flow uphole through the upper completion packer toward the surface.

2. The system of claim 1, further comprising a controller configured to receive water cut sensor data from the water cut sensor, and wherein the controller is configured to output instructions to adjust a flow rate of the formation fluid flowing into the fluid separator based at least in part on the water cut sensor data.

3. The system of claim 1, further comprising a second water cut sensor disposed downhole from the fluid separator, wherein the second water cut sensor is configured to measure the percentage of water in the formation fluid.

4. The system of claim 1, further comprising a lower production tubing having a downhole end coupled to the separator water outlet, wherein the lower production tubing extends through the dual string packer and into the junction annulus to direct the formation water into the junction annulus, wherein the junction annulus is formed in the main bore about the upper production tubing between the dual string packer and the upper completion packer, wherein the junction annulus is fluidly coupled to the lateral bore such that formation water output into the junction annulus is directed to flow into the lateral bore from the junction annulus.

5. A system, comprising a lower completion disposed in a main bore of a multilateral well in a position downhole from a junction of the multilateral well;

a fluid separator configured to receive formation fluid flowing from the lower completion, wherein the formation fluid includes oil and water, wherein the fluid separator is configured to at least partially separate the formation fluid into formation oil and formation water, wherein the fluid separator is configured to output the formation oil, via a separator oil outlet, to flow uphole, and wherein the fluid separator is configured to output the formation water, via a separator outlet to flow toward a lateral bore of the multilateral well;

water cut sensor disposed uphole from the fluid separator, wherein the water cut sensor is configured to measure the percentage of water in the formation oil; and a tubular swivel having an upper portion and a lower portion, wherein the lower portion is rotatable with respect to the upper portion, wherein the fluid separator is connected to the lower portion, and wherein the fluid separator is configured to rotate to a gravitationally up position via rotation of the lower portion of the tubular swivel.

6. The system of claim 1, further comprising a first pressure sensor disposed within the upper production tubing and a second pressure sensor disposed within a junction annulus about the upper production tubing, wherein the first pressure sensor is configured to measure the pressure of the formation oil passing through the upper production tubing, and wherein the second pressure sensor is configured to measure the pressure of the formation water in the junction annulus.

7. The system of claim 1, further comprising a first temperature sensor disposed within the upper production tubing and a second temperature sensor disposed within a junction annulus about the upper production tubing, wherein the first temperature sensor is configured to measure the temperature of the formation oil passing through the upper production tubing, and wherein the second temperature sensor is configured to measure the temperature of the formation water in the junction annulus.

8. The system of claim 1, further comprising at least one fiber optic sensor for distributed acoustic sensing, wherein the fiber optic sensor extends through at least a portion of a junction annulus formed in the main bore proximate the junction.

9. The system of claim 1, further comprising at least one fiber optic sensor for distributed temperature sensing, wherein the fiber optic sensor extends through at least a portion of a junction annulus formed in the main bore proximate the junction.

10. The system of claim 1, further comprising at least one pump configured to drive the formation fluid into the fluid separator from the lower completion, wherein the at least on pump is configured to adjust a flow rate of the formation fluid into the fluid separator in response to instructions received from a controller, wherein the controller is configured to output instructions based at least in part on sensor data received from the water cut sensor.

11. The system of claim 1, further comprising a lateral bore packer disposed within the lateral bore proximate the junction, a lateral bore tubing extending from the lateral bore packer and into the lateral bore, and at least one flow control device, wherein the at least one flow control device is configured to adjust a flow rate of the formation water flowing into the lateral bore from the lateral bore tubing in response to instructions received from a controller, wherein the controller is configured to output instructions based at least in part on sensor data received from the water cut sensor.

12. The system of claim 1, wherein the lower completion includes at least one flow control device, wherein the at least one flow control device includes an inflow control device.

13. The system of claim 1, wherein the lower completion includes at least one flow control device, wherein the at least one flow control device includes an autonomous inflow control device.

14. The system of claim 1, wherein the lower completion includes at least one flow control device, wherein the at least one flow control device includes a density-based autonomous inflow control device.

15. A system, comprising:

a lower completion disposed in a main bore of a multilateral well in a position downhole from a junction of the multilateral well;

a fluid separator configured to receive formation fluid flowing from the lower completion, wherein the formation fluid includes oil and water, wherein the fluid separator is configured to at least partially separate the formation fluid into formation oil and formation water, wherein the fluid separator is configured to output the formation oil, via a separator oil outlet, to flow uphole, and wherein the fluid separator is configured to output the formation water, via a separator water outlet to flow toward a lateral bore of the multilateral well;

a water cut sensor disposed uphole from the fluid separator, wherein the water cut sensor is configured to measure the percentage of water in the formation oil; and a sampler having an upper valve and a lower valve, wherein the sampler is disposed between the fluid separator and an upper completion packer, wherein the lower valve is configured to selectively block flow of the formation oil through an upper production tubing, wherein the upper valve is disposed between the lower valve and the upper completion packer, and wherein the upper valve is configured to open a flow path from a junction annulus to the upper production tubing in response to the lower valve blocking flow of the formation oil through the upper production tubing such that the formation water may flow to the surface via the upper production tubing for sampling.

16. A system comprising:

an orienting liner hanger disposed in a main bore of a multilateral well in a position downhole from a junction of the multilateral well;

a lower completion assembly secured to a downhole end of the orienting liner hanger;

a fluid separator configured to receive formation fluid flowing from the lower completion assembly, wherein the formation fluid includes oil and water, wherein the fluid separator is configured to at least partially separate the formation fluid into formation oil and formation water, wherein the fluid separator is configured to output formation oil into a separator annulus via a separator oil outlet, and wherein the fluid separator is configured to output the formation water, via a separator water outlet, to flow toward a lateral bore of the multilateral well;

a dual string packer secured within the main bore in a position between the fluid separator and the junction of the multilateral well;

an upper completion packer secured within the main bore in a position uphole from the junction;

an upper production tubing extending at least from the separator annulus, through the dual string packer, and to the upper completion packer, wherein the upper production tubing is configured to direct the formation oil from the separator annulus to flow uphole through the upper completion packer;

a lower production tubing having a downhole end coupled to the separator water outlet, wherein the lower production tubing extends through the dual string packer and into the junction annulus to direct the formation water into the junction annulus, wherein the junction annulus is formed in the main bore about the upper production tubing between the dual string packer and the upper completion packer, wherein the junction annulus is fluidly coupled to the lateral bore such that formation water output into the junction annulus is directed to flow into the lateral bore from the junction annulus; and a water cut sensor disposed uphole from the fluid separator, wherein the water cut sensor is configured to measure the percentage of water in the formation oil flowing through the upper production tubing.

17. The system of claim 16, further comprising a lateral bore packer disposed within the lateral bore proximate the junction, a lateral bore tubing extending from the lateral bore packer and into the lateral bore, and at least one flow control device, wherein the at least one flow control device is configured to adjust a flow rate of the formation water flowing into the lateral bore from the lateral bore tubing in response to instructions received from a controller, wherein the controller is configured to output instructions based at least in part on water cut data received from the water cut sensor.

18. The system of claim 17, wherein the lateral bore packer includes a one way valve, wherein the one way valve is configured to prevent the formation water from flowing into the junction annulus from the lateral bore tubing, and wherein the lateral bore packer is configured to seal against the lateral bore to prevent the formation water from flowing into the junction annulus from an annulus of the lateral bore formed about the lateral bore tubing.

19. The system of claim 16, further comprising a first pressure sensor disposed within the upper production tubing and a second pressure sensor disposed within the junction annulus about the upper production tubing, wherein the first pressure sensor is configured to measure the pressure of the formation oil passing through the upper production tubing, and wherein the second pressure sensor is configured to measure the pressure of the formation water in the junction annulus.

20. A method using the system of claim 1, comprising:

drawing formation fluid into the lower completion tubing positioned in a production zone of the main bore of the multilateral well;

pumping the formation fluid into the fluid separator via at least one pump, wherein the fluid separator is disposed uphole from the production zone;

separating the formation fluid into formation oil and formation water via the fluid separator;

drawing the formation oil up hole to a surface through the upper production tubing;

injecting the formation water from the fluid separator into the lateral bore of the multilateral well;

determining the percentage of water in the formation oil flowing through the upper production tubing via at least the water cut sensor, wherein the water cut sensor is disposed uphole from the fluid separator; and adjusting a rate of injection of the formation water into the lateral bore based at least in part on the determined percentage of water in the formation oil.

* * * * *